United States Patent [19]

Axford et al.

[11] Patent Number: 4,656,901

[45] Date of Patent: Apr. 14, 1987

[54] METHOD FOR CUTTING CARPET

[75] Inventors: Robin Axford, Pensax, Near Worcester; John R. Young, Kidderminster, both of England

[73] Assignee: Bondax Carpets Limited, Netherlands

[21] Appl. No.: 725,491

[22] Filed: Apr. 22, 1985

Related U.S. Application Data

[62] Division of Ser. No. 566,675, Dec. 29, 1983, Pat. No. 4,528,882.

[30] Foreign Application Priority Data

Jan. 12, 1983 [GB] United Kingdom ..... 8300708

[51] Int. Cl.[4] ..... B26F 1/40

[52] U.S. Cl. ..... 83/55; 83/522

[58] Field of Search ..... 83/520–522, 83/266, 684, 531, 532, 539–541, 558, 567, 568, 55, 33, 35, 36, 367, 371; 33/180 R

[56] References Cited

U.S. PATENT DOCUMENTS

| | | | |
|---|---|---|---|
| 1,501,072 | 7/1924 | Stanson | 83/33 X |
| 2,185,094 | 12/1939 | Randall | 83/567 X |
| 4,356,747 | 11/1982 | Kjaer et al. | 83/520 X |

FOREIGN PATENT DOCUMENTS 2092501 8/1982 United Kingdom .

*Primary Examiner*—James M. Meister

*Attorney, Agent, or Firm*—Thomas H. Murray; Clifford A. Poff

[57] ABSTRACT

A piece of carpet is placed in a press equipped with a cutting tool and with a plate through which pattern on the carpet can be viewed when the plate overlies the carpet. The position of the plate relative to the cutting tool is accurately controlled and the plate can be moved away from the piece of carpet prior to cutting of the latter. The plate has indicating means which can be aligned visually with selected elements of the pattern of the carpet by manual adjustment of the latter to enable the carpet to be cut at predetermined positions with respect to the pattern.

2 Claims, 2 Drawing Figures

METHOD FOR CUTTING CARPET

This is a divisional of co-pending application Ser. No. 566,675 filed on Dec. 29, 1983, now U.S. Pat. No. 4,528,882.

BACKGROUND OF THE INVENTION

This invention relates to apparatus for and to a method of cutting carpet. The invention is particularly intended for use in cutting carpet into tiles, for example in cutting tiles from rolls of bonded carpet the manufacture of which is described in British Pat. No. 1,421,062 and 1,422,524.

Carpet is generally manufactured in long lengths and carpet tiles are formed from the lengths by a cutting up operation. Hitherto the positions of cuts made in such lengths of carpet have not been accurately predetermined. Precise cutting has hitherto been avoided by manufacturing plain carpet tiles or tiles with a random pattern, in which cases the precise position of the cuts is not important, and by printing pre-cut tiles.

The invention provides a means whereby carpets with repeated patterns can be cut at suitable parts of the pattern to form tiles which can be abutted in any sequence to reform the pattern.

British Pat. No. 1,338,030 of Sidlaw discloses the forming of carpet tiles by cutting the backing only of a piece of carpet (hereinafter referred to as a pelt). The Sidlaw patent makes no reference to a pattern on the carpet and fails to disclose means which would enable a predetermined position between the pattern on the carpet and the cutting tool to be established. Furthermore, the patent teaches that a strip of waste should always be left between adjacent tiles cut from a single pelt so that only one side of any line of cut forms an edge of a tile. Clearly, if the Sidlaw procedure was applied to patterned carpet, it would not be possible to reform a pattern present on the pelt by abutting carpet tiles after cutting and removal of the waste. The Sidlaw procedure and apparatus is not useful for patterned carpet.

The application for the Sidlaw patent was filed on June 12th 1971 and referred to methods in use prior to that date for cutting carpet tiles from lengths of carpet. This shows that the manufacture of carpet tiles from lengths of carpet which do not have a regular pattern has been carried out for well in excess of ten years. However, the problem of cutting accurately patterned carpet to make carpet tiles has not been solved prior to the present application and patterned carpet tiles having a pattern established during construction of the carpet have not been manufactured.

In order to cut satisfactorily carpet tiles from a pelt, each cut must be made between a pre-selected pair of rows of pile tufts and, in each successive tile, the corresponding cut must be made between corresponding rows of tufts. Means for indicating to an operator the position of the pattern on a piece of carpet with the required degree of accuracy and which is suitable for use in commercial production of carpet tiles has not been known in the art, prior to the present invention. It will be understood that the dimensions of pieces of carpet cannot be controlled within close tolerances to ensure that successive pelts will have the same dimensions and will have the pattern correspondingly positioned, within the tolerances necessary to cut between a pre-selected row of tufts, and that commercial production of patterned carpet tiles can be viable only if each successive pelt can be positioned quickly for cutting.

British Pat. No. 1,181,731 of Stafford Tool and Die Company discloses apparatus for cutting pieces of textile material of predetermined size and shape from larger pieces. The apparatus includes a cutting blade and spikes on which the larger pieces of material can be impaled. No suggestion is made that a predetermined relation between the cutting blade and a pattern on the pieces of material could be established. The spikes pierce the textile material from below and piercing of a piece of carpet at predetermined postions with respect to a pattern on the upper face would not be practicable. Furthermore, the spikes are spaced substantially from the cutting tool so that piercing of a piece of textile material by a spike at a predetermined position in a pattern on the material would not ensure cutting of the material exactly at a pre-selected position by the cutting blade.

Apparatus for establishing registration of pattern on successive pieces of fabric incorporated in a stack is disclosed in British Patent Application No. 2,045,724 of Rhomberg. This apparatus includes two spot-lights which project images of respective graticules onto the surface of the fabric so that selected elements of the pattern can be adjusted to the positions of these images. An image of a graticule projected by a light source onto patterned pile fabric cannot be seen sufficiently clearly to facilitate rapid, accurate positioning of the pile fabric relative to the graticule. The procedure described in Application No. 2,045,724 is proposed for cutting out pieces of fabric which are to be used in the construction of garments. The cutting of carpet at predetermined positions in a pattern of the carpet has not previously been contemplated in the art, owing to the lack of knowledge as to how the carpet could be positioned sufficiently accurately and quickly relative to a cutting blade.

In U.S. Pat. No. 3,400,925 issued to Tobias, there is disclosed apparatus having a transparent plate with an edge along which a tool for cutting sheet material underlying the plate can be moved. The sheet which is to be cut is placed on a fixed surface of the apparatus and the transparent plate is moved until the edge thereof is at a selected position on the sheet. The sheet is then cut along the edge of the plate. This arrangement is used for cutting a line of type-written characters from photocomposed text, in order that a line containing an error can be replaced by corrected text. The cutting tool is applied to that face of the sheet which is engaged by the transparent plate. This apparatus would not be useful in the production of patterned carpet tiles. The movement of the transparent plate to bring an edge thereof into coincidence with successive lines where a carpet pelt is to be cut would require an excessive period of time for the cutting of each tile. Furthermore, cutting would damage the pile tufts.

Apparatus with a pointer to assist positioning of a workpiece is disclosed in U.S. Pat. No. 1,166,261 issued to Rogers. This patent discloses a press equipped with a punch and with a movable pointer having a tip which occupies the position at which the centre of the punch will engage the workpiece, until the punch descends. The pointer is then automatically moved out of the path of the punch. Whilst this apparatus may be useful to enable a user to position a centre mark on a workpiece in the path of a centre of a punch, it would not enable a carpet pelt bearing a pattern to be positioned with the pattern in a predetermined relation to a cutting blade for cutting a tile from the pelt. Even if the pointer disclosed in the Rogers' patent was duplicated, the pointers would not be convenient for positioning a carpet pelt. To position accurately the pattern on a piece of carpet in relation to cutting blades, it is necessary for an operator to view the piece of carpet from above and to have a similar view of different parts of the pattern. In the Rogers' apparatus, an operator is prevented by the press from occupying a position from which a satisfactory view of a piece of carpet could be obtained. A person skilled in the art of carpet tile manufacture would not be led by the Rogers' patent to adopt the Rogers pointer in a press for cutting carpet tiles, since the pointer would clearly be inadequate to solve the problem of accurate positioning of patterned carpet.

SUMMARY OF THE INVENTION

According to one aspect of the invention, a carpet tile is cut from a single, patterned piece of carpet by placing the piece of carpet on a base with the pile uppermost, adjusting the position of the piece of carpet relative to the base by reference to indicator means which is spaced upwardly from the base to overlie the piece of carpet, the indicator means touching the pile of the carpet where registration between the indicator means and the pattern of the carpet is to be achieved, and then forming in the backing of the carpet cuts which form a closed figure at a predetermined position relative to the base, without the cuts extending into the pile of the carpet.

DESCRIPTION OF THE PREFERRED EMBODIMENTS

Figure 1:
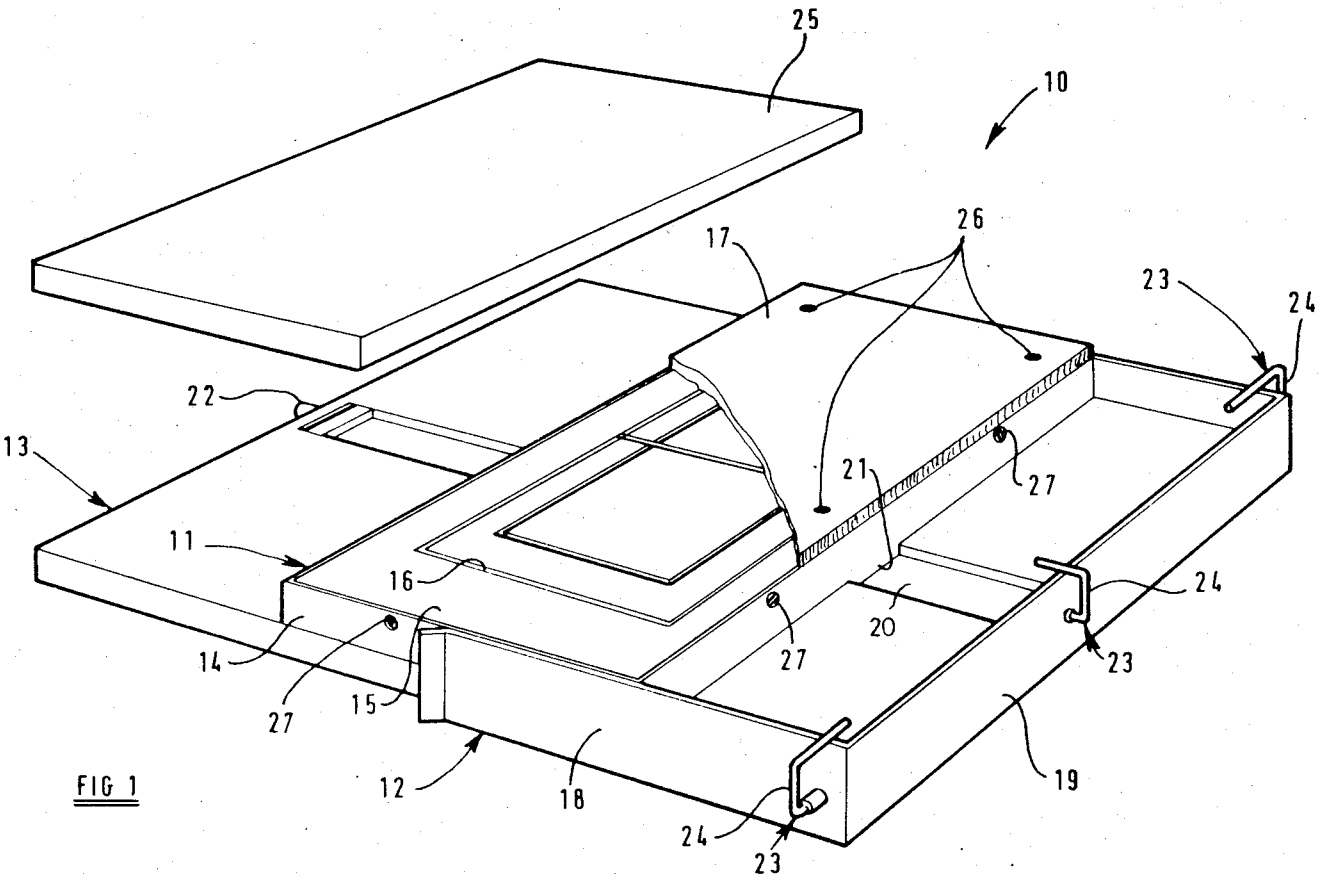
FIG. 1 is a diagrammatic perspective view of certain parts of one example of apparatus in accordance with the invention.

Apparatus 10 shown in FIG. 1 for use in cutting carpet tiles comprises a support 11 on which a piece of carpet 17 (partly broken away) rests. The support is slidable along a path defined by a frame 12 and a table 13 of the apparatus. The path is substantially rectilinear and substantially horizontal. The support is movable along the path between two limit positions which are a positioning location and a cutting location, as will be hereinafter described. The support is shown in an intermediate position between the limit positions.

The frame 12 is three sided and comprises opposite side elements 18 which engage side portions of the support, and an end element 19 which limits travel of the support in one direction. The frame extends around portions of the table 13 on which the support rests. In addition to the engagement of side portions of the support with the frame when the support is in the positioning location and when the support is moved from that location through the intermediate position, the support is guided for movement along the path by means of a groove 20 in the table which extends along the length of the path and which receives a runner 21 of the support. Adjustment means 22 at one end of groove 20 enables the position of the support in the cutting location at one end of the path to be adjusted. The adjustment means extends into the groove 20 for engagement with an end face of runner 21.

The support 11 comprises a base 14 which rests on and is slidable on the table 13 and on which is mounted the runner 21. A layer of resiliently compressible material 15 is also mounted on the base, which layer can be a foam material. The foam layer provides a substantially horizontal upwardly facing surface on which the piece of carpet 17 rests when the apparatus is in use.

A set of blades 16 is mounted on the support 11 to extend upwardly through gaps in the foam layer 15. The blades form two adjacent square outlines for cutting a pair of tiles of the same size from the piece of carpet 17 resting on the support. Further sets of blades can be mounted in further gaps in the foam layer when tiles of different sizes are to be cut and sets of blades arranged for cuttig more than two tiles from a single piece of carpet may be used.

The position of the blades and foam layer relative to the base 14 can be adjusted by screw means 27 which extend through a rim of the base from positions around the perimeter of the base. The tips of the blades lie below the surface level of the foam layer 15 when the piece of carpet rests on the layer.

Indicator means for use in comparing the position of the piece of carpet 17 with a required position are provided adjacent to the positioning location. The indicator means provide a convenient reference which enables the carpet to be positioned on the support in a predetermined relation to the support. The carpet may be positioned automatically by means of apparatus (not shown) which senses the relative position of the carpet pattern and the indicator means and which can move the carpet accordingly. Alternatively the carpet may be positioned manually.

The indicator means are mounted on the frame 12 of the apparatus and parts at least of said means are movable with respect to the support. The apparatus shown in the drawing comprises indicator means in the form of three wire pointers 24 mounted on respective elements of the frame. The wire pointers on the side elements 18 of the frame are pivotally mounted on said frame about an axis which extends in a direction parallel to the length of element 19 and perpendicular to the path of travel of the support 11. The pointers are shown in first positions spaced upwardly from the support by a distance approximately equal to the thickness of the carpet so that they touch or closely overlie the pile surface of the carpet and are pivotable to further positions spaced generally further away from the support.

Figure 2:
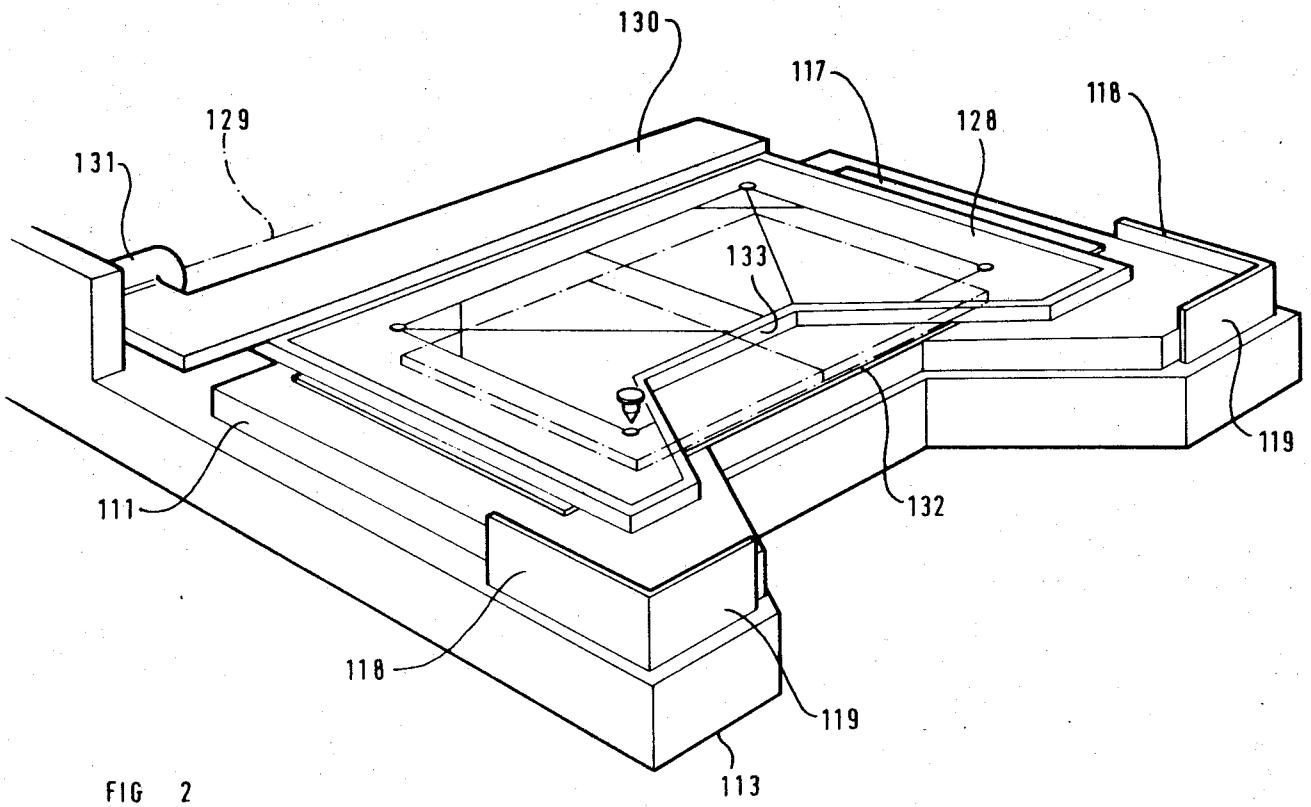
FIG. 2 is a similar view of a modified form of the apparatus illustrated in FIG. 1.

In the modified apparatus illustrated in FIG. 2, the indicator means are provided on a single indicator member which is movable between first and second postions so that the indicator means move together with each other when the indicator member is moved. The indicator member preferably has the form of a plate 128 and, when in its first position, closely overlies the piece of carpet 117 on the support, when the support is in the positioning location.

Certain parts of the modified apparatus shown in FIG. 2 which correspond to parts hereinbefore described with reference to FIG. 1 are indicated by like reference numerals with the prefix 1 and the preceding description is deemed to apply to such parts, except for the differences hereinafter mentioned.

In its second position, the indicator member 128 is spaced generally further from the support 111 than when in its first position. In its second position, the indicator member is so spaced from the support that it does not impede removal of the piece of carpet 117 from the support and the placing of a further piece of carpet on the support. The indicator member is adapted to permit the piece of carpet 117 to be viewed through the indicator member when the latter is in its first position. The indicator member may be transparent or may include a transparent part. Alternatively, there may be formed in the indicator member one or more apertures through which the piece of carpet can be viewed.

The indicator member may be reciprocable upwardly and downwardly between its first and second positions Alternatively, the indicator member may be pivotable, as illustrated in FIG. 2, between the first position illustrated and the second position (which is not shown). As illustrated, the indicator member may be pivotable about an axis 129 which is perpendicular to the path of movement of the support 111 between the positioning location and the cutting location and which is above the level of the support and, preferably, above the level of the piece of carpet 117. The indicator member is preferably releasably connected with the remainder of the apparatus, for example being releasably fixed to a carrier 130 which is itself pivotally connected with a stationary part of the apparatus by a bearing 131. With this arrangement, the indicator member can readily be substituted by a further member with different marks for use in cutting different tiles, for example, tiles of different sizes or different shapes or tiles having different patterns, without disturbance of the bearing 131. The bearing 131 is selected to ensure that the position of the indicator member relative to the table 113, when the indicator member is in its first position, is predetermined, within negligable tolerance limits, in directions along the path of movement of the support and laterally of the path of movement of the support.

The indicator member 128 may bear marks or have formations with which selected tufts in the piece of carpet 117 or selected elements of a pattern on the piece of carpet can be aligned visually by an operator. Alternatively, the indicator member may bear the same pattern as the piece of carpet or selected elements of the pattern on the piece of carpet. The pattern or part thereof may be marked on the indicator member or an image of the pattern or part thereof may be projected onto the indicator member.

There are mounted in the indicator member 128, at respective positions which coincide with corners of the carpet tiles to be produced, pins which engage respective tufts of the piece of carpet 117 and thereby facilitate accurate positioning of the carpet by the operator relative to the indicator member. The pins are demountable from the indicator member and the latter is provided with alternative holes, at other positions, in whch the pins can be mounted when tiles having different size are to be produced.

In a further alternative arrangement, the indicator means provided on the indicator member is adapted to respond to the presence in respective predetermined positions relative to the indicator member of certain tufts or pattern elements of the piece of carpet 117. Thus, the indicator means may comprise optical sensing devices which respond to white tufts, tufts of a certain colour or fluorescent tufts. Alternatively, the indicator means may be electromagnetic and be adapted to respond to the presence of a metallic tuft. In each case where the indicator means is adapted to respond to the presence of an element of the piece of carpet 117 at a predetermined position, there may be provided means for signalling to an operator when the selected elements of the carpet are in the required positions. For example, there may be four indicator means adapted to respond to respective tufts near to the corners of a rectangular piece of carpet and respective light sources which are energised by the indicator means when these tufts are in the required positions, the operator being able to adjust the position of the piece of carpet until he sees that all four light sources are energised.

To facilitate adjustment of the position of the carpet by the operator, a marginal portion 132 of the carpet nearest to the position at which the operator stands is exposed in a recess 133 in that edge of the indicator member 128 which is nearest to the operator. To enable the operator to approach closely to the piece of carpet 117, a similar recess is preferably formed in the table 113 and in the support 111. To enable the operator to enter these recesses, the means for accurately determining the position of the support 111 relative to the table 113, when the support is in the positioning location, is arranged to engage the support near to front corners of the support but it is interrupted between those front corners.

In the example illustrated in FIG. 2, the position of the support 111 is accurately determined by side wall portions 118 and front wall portions 119 which collectively correspond to the frame 12 hereinbefore described.

In the example illustrated in FIG. 2, where the indicator member 128 is formed of transparent material, there are marked on the indicator member lines which coincide with the cutting blades in the support and therefore with the edges of the tiles to be formed. As shown, there may also be marked on the indicator member diagonals of the tiles which are to be formed.

The apparatus illustrated in FIG. 1 and the modified apparatus of FIG. 2 each includes a press ram (shown only in FIG. 1 at 25), beneath which the support 11 or 111 is positioned when in its cutting location. The press can be operated to drive the ram downwardly into engagement with the upper surface of the carpet 117 and thereby drive the backing of the carpet onto the blades 16 on the support.

The sequence of operation of the apparatus 10 is begun when the support 11 is in the positioning location at one end of its path. When the support is in this position, its position is accurately determined by the frame 12. The movable indicator means 23 are pivoted to the further position spaced away from the support to facilitate placement of carpet on the upwardly facing surface of the foam layer 15. The indicator means are then pivoted back to the first position, and the indicator means is used in a comparison of the position of the carpet with a required position to enable the operator to move the carpet into a predetermined position on the support. The carpet comprises marker tufts 26 at predetermined positions on the carpet to facilitate positioning thereof and the positions of these tufts are compared with those of the indicator means. These marker tufts lie between the blades 16 and the periphery of the piece of carpet, so that they are included in the offcuts, not in the tiles.

When the carpet has been correctly positioned on the support, the support is slid from the positioning location to the cutting location at the opposite end of its path. It will be understood that the path of travel of the support is controlled by the table 13 somewhat less precisely than is the position of the support controlled by the frame 12. Thus, when the support is outside the frame, its position is controlled somewhat less precisely. However, variations in the position between the ram 25 and the piece of carpet do not affect the position at which the carpet is cut.

The press is then activated to move downwardly and thereby act on the carpet. The press causes the foam layer 15 to compress underneath the carpet so that a backing of the carpet is brought into cutting engagement with the set of blades 16. When cutting has taken place, the ram moves upwardly away from the tiles, the support is returned to the positioning location and the tiles and off-cuts are removed from the support so that the operation can be repeated with another piece of carpet. The stroke of the press may be short, since the ram does not obstruct the view of the piece of carpet which is to be cut, when that piece of carpet is positioned on the support and the support is in the positioning location. Accurate positioning of the piece of carpet could not be carried out sufficiently quickly for commercial production, if that positioning were carried out with the piece of carpet lying below the ram of the press.

The movable indicator means are moved to the further position after use and before the tiles are removed from the support. When in the further position, these indicator means do not obstruct or inhibit removal of the tiles from the support and placing of a further piece of carpet on the support.

In a similar way, the indicator member 128 of the apparatus shown in FIG. 2 is moved to its second position, once the piece of carpet has been correctly positioned, and before the support 111 is moved to the cutting location. When the support is returned to the positioning location, the offcuts and cut tiles can readily be removed from the support and replaced by a further piece of carpet, before the indicator member is moved into its first position to assist with correct positioning of the piece of carpet.

Positioning of the piece of carpet on the support may be carried out automatically, rather than manually. Thus, movable grippers may be provided for gripping the piece of carpet and drive means for moving the grippers in a predetermined manner until indicator means signals that the carpet is in the required position. Apparatus for moving the carpet automatically may be used for cutting tiles from an end portion of a roll of carpet, without first severing the end portion from the roll. An end portion would be unrolled from the roll of carpet and advanced to the required position on the support. The major part of such advance may be effected relatively quickly, a final adjustment of the position of the end portion being effected more slowly. Such adjustment may include movement along the length of the carpet and laterally of the carpet. Automatic positioning means may be used to position the carpet on a stationary support which remains below the ram of the press. Alternatively, once the required position of the end portion of the carpet relative to the support has been established, relative movement of the blades and carpet with respect to the press ram may be effected to bring the blades and carpet beneath the press ram for cutting.

We claim:

1. A method of cutting carpet tiles from a patterned carpet, wherein the carpet is formed with marker tufts which are used for positioning the carpet and which lie between the periphery of the carpet and the location at which the carpet is cut, said method comprising the steps of placing the carpet on the support at a distance from a cutting device, moving indicator means to overlie the carpet comparing the position of the marker tufts with the position of the carpet and therefore the marker tufts to a predetermined position relative to the indicator means, moving said support and the carpet position thereon away from said indicator means to a location beneath said cutting device, and forming cuts in the carpet at predetermined positions relative to the support, after which the marker tufts are included in off cuts and not in said carpet tiles.

2. A method of producing carpet tiles comprising the steps of attaching to a ground member pile comprising a plurality of pattern tufts and a plurality of marker tufts distinct from the pattern tufts, placing the ground member bearing said tufts on a support, said support positioned at a distance from a cutting device, moving indicator means to overlie the carpet comparing the position of the carpet and therefore of the marker tufts to a predetermined position relative to the indicator means, moving said support and the carpet positioned thereon away from said indicator means to a location beneath said cutting device then forming cuts with said cutting device in the ground member a predetermined positions relative to the support to form a tile including at least some of said pattern tufts, the position of the cuts being such that said marker tufts are excluded from said tile and are included in an offcut, after which said offcut containing said marker tufts is discarded.

* * * * *